US006491465B2

(12) United States Patent
Lai

(10) Patent No.: US 6,491,465 B2
(45) Date of Patent: Dec. 10, 2002

(54) WRITING IMPLEMENT WITH A DISPLACEABLE REFILL

(76) Inventor: Kui Cheung Lai, Room 1706 Modern Warehouse, 6 Shing Yip Street, Kwun Tong, Kowloon (HK)

( * ) Notice: Subject to any disclaimer, the term of this patent is extended or adjusted under 35 U.S.C. 154(b) by 0 days.

(21) Appl. No.: 09/829,911

(22) Filed: Apr. 11, 2001

(65) Prior Publication Data

US 2001/0028821 A1 Oct. 11, 2001

(30) Foreign Application Priority Data

Apr. 11, 2000 (DE) ..... 100 17 939

(51) Int. Cl.[7] ..... B43K 7/12
(52) U.S. Cl. ..... 401/117; 401/109; 401/111
(58) Field of Search ..... 401/112, 117, 401/109, 99, 111

(56) References Cited

U.S. PATENT DOCUMENTS

| | | | | |
|---|---|---|---|---|
| 2,427,068 A | * | 9/1947 | Randolph | 401/111 |
| 2,896,577 A | * | 7/1959 | Merryman et al. | 401/111 |
| 2,988,054 A | * | 6/1961 | Yates | 401/111 |
| 3,989,389 A | | 11/1976 | Hashimoto et al. | 401/30 |
| 4,720,203 A | | 1/1988 | Shimada | 401/94 |

FOREIGN PATENT DOCUMENTS

| | | |
|---|---|---|
| CN | 1091084 | 10/1993 |
| DE | 25 14 078 | 3/1975 |
| DE | 42 42 272 | 12/1992 |
| EP | 0 496 944 | 9/1991 |
| GB | 1378838 | 12/1994 |

* cited by examiner

*Primary Examiner*—David J. Walczak
(74) *Attorney, Agent, or Firm*—Leydig, Voit & Mayer, Ltd.

(57) ABSTRACT

A writing implement includes a shaft, a refill having a writing tip and that is displaceable co-axially in the shaft, a resilient restoring member acting between the shaft and the refill, a shifting mechanism and a push member associated with the shifting mechanism. The shifting mechanism is actuable by the push member so the refill and its writing tip can be displaced into a writing position against the action of the restoring member and, with repeated actuation , is returned to a rest position. The push member co-operating with the shifting mechanism is movable axially in a longitudinal direction of the shaft and the refill. An actuating lever projects from the end of the shaft, remote from the writing tip, and pivots with respect to shaft. The actuating lever acts upon a side of the push member remote from the shifting mechanism, converting pivoting movement of the lever into axial movement of the push member.

13 Claims, 2 Drawing Sheets

8a
8
11
13
14
16
18
19
20
2
5
6
9
10
12

WRITING IMPLEMENT WITH A DISPLACEABLE REFILL

The present invention relates to a writing implement having a displaceable refill, such as a retractable ball-point pen or a propelling pencil.

BACKGROUND OF THE INVENTION

Writing implements of the type concerned are known, which have a shaft, a refill having a writing tip and displaceable in the shaft, and a shifting mechanism which is actuable by a push button and by means of which the refill and its writing tip can be displaced into a writing position against a restoring force or a spring and with repeated actuation can be displaced back into a rest position. The push button cooperating with the shifting mechanism is movable axially in the direction of the longitudinal extent of the shaft and the refill.

Writing implements of this type—as a rule in the form of ball-point pens—are widely known. If the push button is actuated, the refill is displaced in the longitudinal direction of the shaft constructed in the form of a casing, in such a way that the writing tip emerges from the front end of the said shaft. The shifting mechanism then ensures at the same time that the refill is fixed in this position. Repeated actuation of the push button releases the writing position of the refill, so that the restoring force or restoring spring can then push the refill back into the rest position, in which the writing tip comes to rest inside the shaft.

A writing implement of this type, in the form of a retractable ball-point pen, is disclosed in German Gebrauchsmuster (Utility Model) No. 297 16 002 U1, which includes a printed sleeve arranged in a viewing window and rotatable at the same time in that case by the shifting mechanism.

In a writing implement or retractable ball-point pen of this type, the push button, which projects out from. the upper end of the shaft, has to be moved almost exactly axially by the user.

The object of the invention is to provide a writing implement of the type concerned in general, in which the push button is arranged to be protected within the shaft, and at the same time a simple or convenient actuation is made possible.

SUMMARY OF THE INVENTION

According to the invention, there is provided a writing implement including an actuating lever projecting at the end of the shaft remote from the writing tip, and mounted pivotably with respect to the shaft, with its pivoting movement being changeable or convertible into an axial movement of the push button, which is acted upon by the lever on the side of the push button remote from the shifting mechanism.

A pivotable actuating lever is thus provided at the end of the shaft, so that the actual push button acted upon by this pivoting lever can be protected inside the shaft. In addition, the actuation of a pivoting lever on a retractable ball-point pen or a similar writing implement represents an original and novel manner of actuation, which is expected to prompt commercial acceptance of the product. It is simple and convenient to operate a pivotably mounted actuating lever, with its pivotal movement taking place against the restoring force and restoring movement of the push button. Pivoting of the actuating lever will cause displacement of the refill into the writing position and, in the next instant, its return displacement into the rest position, so that the user can perform the same movement each time to effect different displacement actions of the refill and its writing tip.

In order to convert the pivoting movement of the actuating lever into the axial movement of the push button, at least one oblique face may be provided in the region of the contact between the actuating lever and the push button, on at least one of these parts. The push button and the actuating lever need not therefore be rigidly connected to each other, but only have to touch or abut each other, so that the pivoting movement of the actuating lever can be converted by reason of the aforesaid oblique face into the axial movement of the push button guided axially in the shaft. Conversions of pivoting movements by way of oblique faces into movements guided in straight lines are known per se from other technical fields, so that what is involved herein is also a possibility that can be technically simple to implement.

The oblique face used for converting the pivoting movement of the actuating lever into the axial movement of the push button may be flat or may be curved in a convex or concave manner at least in part. As a result of the shaping of the oblique face or its surface lines, the translation and conversion of the pivoting movement into the axial movement can be effected in such a way as is expedient for a smoothly running and effective displacement of the writing tip. The size of the pivoting angle can also be determined and kept within suitable limits by the choice of the oblique angle and the shape of the oblique face.

A particularly effective conversion of the pivoting movement of the actuating lever into an axial movement of the push button can be attained if at least one oblique face is provided in each case in the region of the contact of the pivoting lever and the push button both on the actuating lever and on the push button, and the mutually touching oblique faces slide one over the other, or each other, during pivoting of the actuating lever. Although the counter member can be moved by a relative movement of one part with respect to an oblique face, the mutual displacement and thus the conversion of a pivoting movement into a movement in a straight line is more effective if two suitably shaped and mutually adapted oblique faces cooperate on the two parts movable relative to each other, in which case the shape of the oblique face—in a straight line or curved in cross-section—can be adapted to effect such a mutual displacement movement.

A structurally simple arrangement of the writing implement and, in particular, the contact region between the push button and the actuating lever can consist in that on its side or end face towards the actuating lever the push button has a taper comprising or forming the oblique face, the surface of the said taper coming increasingly closer, or converges, in the direction away from the writing tip along the central axis of the writing implement. A recess, which has a negative oblique face and which engages over the oblique face of the push button in the rest position, may be provided at the end of the actuating lever towards the push button.

The oblique face may be shaped in the form of a taper arranged at the end of the push button. A corresponding recess in the actuating lever may engage over this taper, so that pivoting of the lever displaces the taper in the axial direction and thus actuates the push button. As a result of the use of a suitably shaped recess engages over the taper, pivoting of the actuating lever in opposite directions can have the same effect in each case.

It is particularly advantageous if the recess provided on the actuating lever is substantially symmetrical to the central axis of the actuating lever, and the taper provided at the end of the push button engages on mutually opposite sides over the oblique areas arranged on both sides of this axis in the rest position. A symmetrical shaping of this type allows the push button to be actuated by any mutually opposed pivoting movements of the actuating lever. There is no need for a user to observe any specific pivoting direction, and he can pivot the actuating lever in either one or the other direction, each time achieving the desired actuation of the push button.

A still more extensive multiplicity of the possibilities of actuation occur when the oblique face on the push button or the taper forming it is formed as a pyramid, cone or part of a sphere, and the recess on the actuating lever has a negative contour matching it, and the actuating lever is mounted for pivotal movement in several or all directions. In such a case, in which the oblique face on the push button and the corresponding oblique face on the actuating lever are also designed in three dimensions, i.e. extend towards any desired sides, any desired pivoting movement of the actuating lever can therefore be performed in order to actuate the push button. It is particularly advantageous if the cross-section extends at right angles to the central axis of the writing implement through the oblique face on the push button and through the recess in the actuating lever are both circular. As a result, pivoting of the actuating lever in any direction always results in the same axial. displacement movement of the push button, so that a very convenient and simple operation of the writing implement is made possible for its refill to be displaced into the writing position and back again.

The contact region, in particular the recess, acting upon the push button and arranged at the end of the actuating lever facing the push button can be arranged on a substantially spherical thickened or enlarged portion of the actuating lever. Over this spherical portion an undercut in the end of the shaft engages, so that the tapering shaft—which includes the undercut—itself supports the actuating lever for pivotal movement.

This results in a form of the actuating lever which is shaped particularly advantageously from the structural point of view, since its spherical thickened portion on the one hand can comprise the contact with the push button, in particular a recess, and, in addition, has sufficient space and at the same time represents the part which in the shaft with the undercut provided there forms the pivoting support for the actuating lever.

It is advantageous that the spherical thickened portion of the actuating lever is movable or displaceable in the axial direction of the shaft—in the direction towards the writing tip—with respect to the undercut. With this arrangement, if intended, the user can also actuate the actuating lever like a projecting push button, i.e. he can press on the actuating lever in the axial direction, whereby the push button acted upon by the actuating lever is in turn moved axially. Such a displacement for actuation is possible as a result of the undercut engaging over the spherical thickened portion only in the axial direction away from the writing tip. The shaping and the production of the shaft as well as the assembly of the actuating lever are also correspondingly simple.

Preferably, the actuating lever projecting from the end of the shaft is surrounded by a resiliently deformable cover. As a result, not only is soiling in the region of the mounting of the actuating lever eliminated, but the actuating lever is also protected from inadvertent damage and is prevented from disengaging from its mounting position.

More preferably, the cover surrounds the free end of the actuating lever remote from the shaft in the rest position, in particular at least to touch it during its actuation and to act as a restoring element for automatically centering the pivotable actuating lever, upon release, by virtue of its resilience. In the situation after a user has pivoted the actuating lever and moved the refill into the writing position, the push button and the actuating lever will no longer be in contact under the restoring force or the force of the restoring spring, the actuating lever will nevertheless be pivoted by the cover back into its initial central position co-axial with the shaft. The cover. thus has a double function, as. it protects the actuating lever and moves it back into its initial position after each pivoting movement.

The resilient cover may be made substantially cap-shaped, and the edge of its rim can be clamped between the shaft and a retaining ring for a clip of the writing implement. This represents a particularly simple arrangement and fastening for the actuating lever.

With individual or several of the features described above combined, a writing implement is produced, the refill of which is movable by means of a push button against a restoring force into a writing position and, with repeated actuation, is movable into a rest position under the action of the restoring force, in which case, however, the push button can be concealed and protected in the interior of the shaft and can be displaced indirectly by way of a pivotable actuating lever. The use of the pivotable actuating lever represents a very simple and convenient operation.

BRIEF DESCRIPTION OF DRAWINGS

An embodiment of the invention is described in greater detail below with reference to the drawing, in which.

DETAILED DESCRIPTION OF PREFERRED EMBODIMENT

A writing implement designated 1 as a whole has, in a conventional manner, a dividable shaft 2 which can be taken apart in order to enable replacement of a refill 4 provided with a writing tip 3 and displaceable in the shaft 2.

Figure 3:
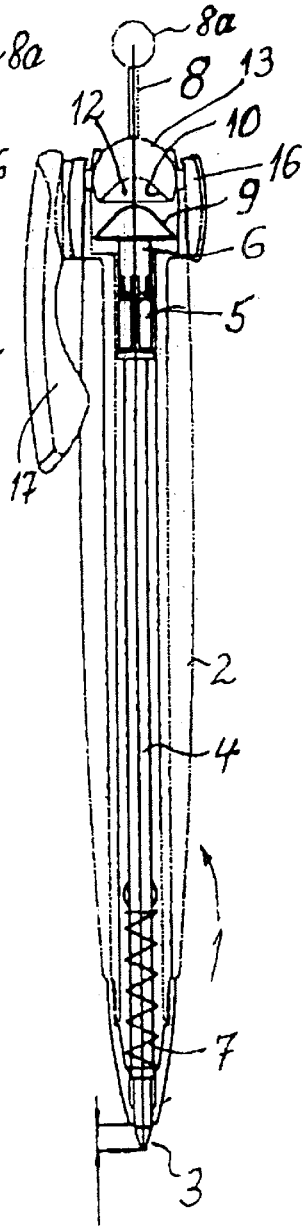
FIG. 3 is a cross-sectional side view corresponding to FIG. 2, in which the actuating lever is released and the shifting mechanism fixes the writing tip in the writing position.

In the end region remote from the writing tip 3, the shaft 2 contains a shifting mechanism 5 (illustrated only in part) which is known per se from retractable writing implements of this type such as retractable ball-point pens, and which is actuable by means of a push button 6. The shifting mechanism 5 can be displaced in the axial direction, with the aid of the push button 6, in order to occupy a writing position (FIG. 3) on the one hand and a rest position (FIG. 1) on the other hand.

The refill 4 and its writing tip 3 can therefore be displaced by means of the shifting mechanism 5 against a restoring force, or in this particular embodiment against the force of a spring 7 into the writing position and, upon renewed actuation, back into the rest position, as is generally known in the art. More specifically, the push button 6 cooperating with the shifting mechanism 5 is movable axially with the refill 4 in the direction of the longitudinal extent of the shaft 2 and refill 4.

In the present embodiment, in contrast to conventional ball-point pens having a shifting mechanism and a push button which has to project out of the shaft for actuation, the push button 6 is arranged completely in the interior of the shaft 2 in a protected manner, and an actuating lever 8, which projects at the end of the shaft 2 remote from the writing tip 3, is mounted pivotably with respect to the shaft 2. The pivoting movement of the actuating lever 8 can be converted or changed into an axial movement of the push button 6 acted upon by the actuating lever 8 (FIGS. 2 and 5), engaging on the side of the push button 6 remote from the shifting mechanism 5.

The user does not therefore actuate the push button 6 directly, but indirectly by way of the actuating lever 8 and for this purpose does not perform an axial pressing movement, but a pivoting movement, so that a highly precise axial actuating movement by the user is no longer necessary. Pivoting the actuating lever 8 automatically results in the necessary precise axial movement of the push button 6.

Figures 4, 5, 6:
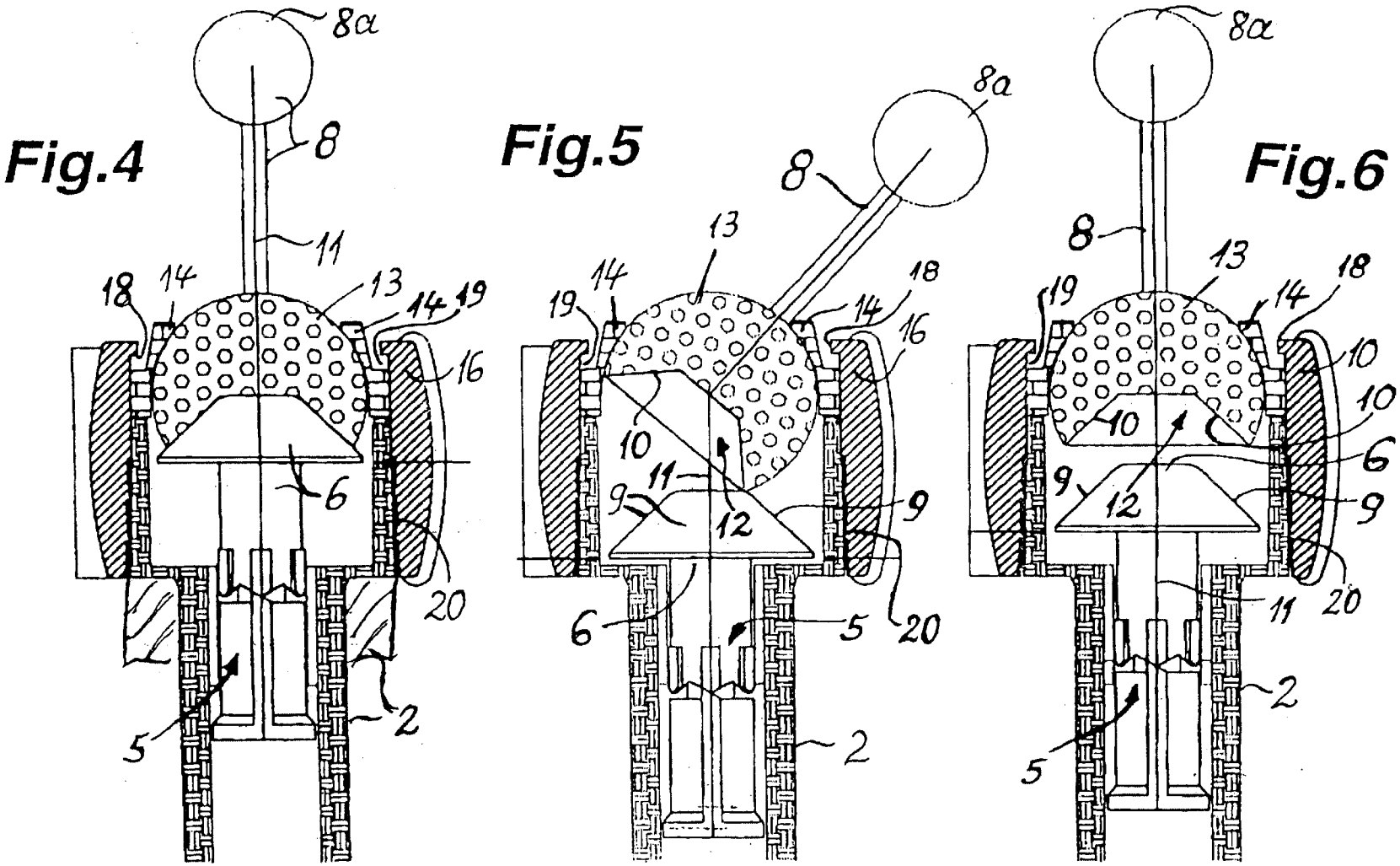
FIG. 4 is an enlarged fragmentary cross-sectional side view equivalent to FIG. 1, showing the push button and part of the shifting mechanism as well as the mounting of the pivoting lever in the rest position.
FIG. 5 is an enlarged fragmentary cross-sectional side view equivalent to FIG. 2, showing the push button and the part of the shifting mechanism connected thereto subject to th e greatest possible axial displacement by pivoting the actuating lever.
FIG. 6 is an enlarged fragmentary cross-sectional side view equivalent to FIG. 3, showing the actuating lever being released and the shifting mechanism with the push button being retained against the restoring force, in which the refill and its writing tip are in the writing position.

In order to convert the pivoting movement of the actuating lever 8 into the axial movement of the push button 6, oblique (frusto-conical) surfaces or faces 9 and 10 are provided in the region of the contact between the push button 6 and the actuating lever 8, respectively. The oblique face 9 on the front end of the push button 6 is used in particular to convert the pivoting movement of the actuating lever 8 into the axial movement of the push button 6, since during the pivoting of the actuating lever 8 its contact region can slide along the oblique face 9 with axial displacement, as can be visualised through comparison of FIGS. 4 and 5 or FIGS. 1 and 2. In this particular embodiment, the oblique face 9 used to convert the pivoting movement of the actuating lever 8 into the axial movement of the push button 6 is flat as viewed in section, i.e. the meridian lines of this oblique face 9 extend straight as shown in FIGS. 4 to 6. It is envisaged that, however, such section or meridian lines can be curved.

Figure 1:
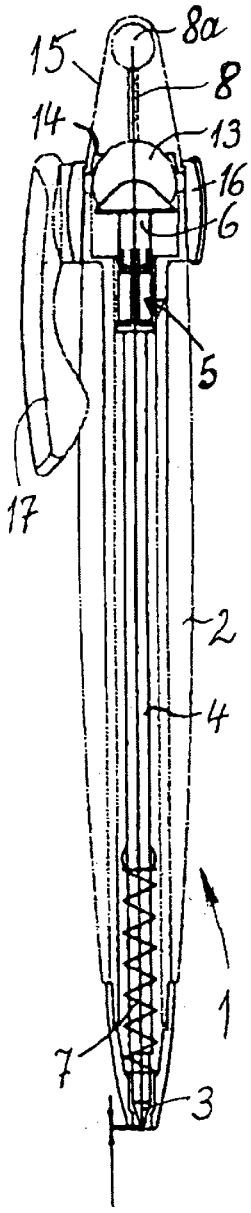
FIG. 1 is a cross-sectional side view of a writing implement embodying the invention, in which the writing tip of the refill is withdrawn by a restoring spring into the interior of the shaft and the push button is arranged next to a shifting mechanism provided within the end of the shaft opposite the writing tip and is abutted by a pivotable actuating lever in the rest position.

It is apparent from FIGS. 4 to 6 in particular that in the region of the contact of the pivotable actuating lever 8 and the push button 6, i.e. on the side of the push button 6 having the oblique face 9, an oblique face is provided in each case both on the actuating lever 8 and on the push button 6. Such oblique faces 9 and 10, which are in mutual contact in the rest position as shown in FIGS. 1 and 4, slide apart during said pivoting of the actuating lever 8, in which case, however, the actuating lever 8 remains in contact with the oblique face 9 and displaces it in such a way that the push button 6 is displaced out of the position illustrated in FIG. 4 into the position visible in FIG. 5, through a cam action.

Figure 2:
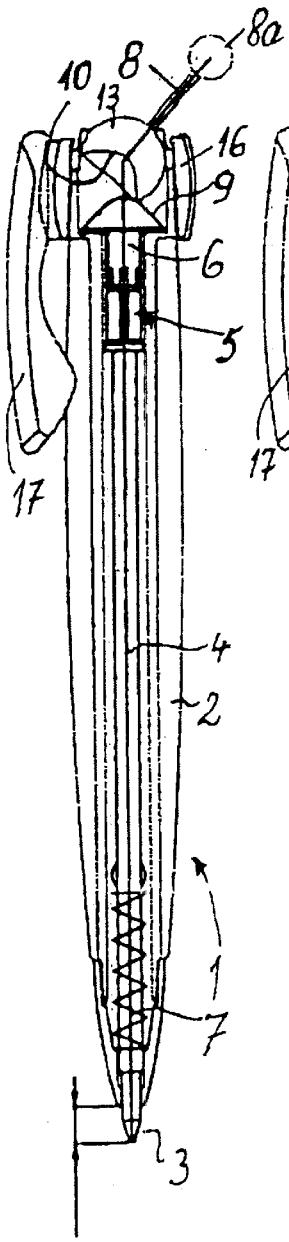
FIG. 2 is a cross-sectional side view corresponding to FIG. 1, in which the actuating lever is pivoted into an outermost pivoting position, and the push button and thus the refill and its writing tip are thereby displaced axially into the writing position.

In the position of FIG. 5, or FIG. 2, the refill 4 and its writing tip 3 are pushed slightly beyond the writing position, so that when the actuating lever 8 and thus the push button 6 are released the refill 4 and the shifting mechanism 5 are fixed in their writing positions of FIG. 6 under the action of the restoring force of the spring 7, as is generally known from shifting mechanisms of this type.

In the writing position of FIG. 6, the released actuating lever 8 is at a small distance from the side of the push button 6 facing it. Upon repeated pivoting into the position illustrated in FIG. 5, the actuating lever 8 acts upon the push button 6 on the oblique face 9 and moves it into the position illustrated in FIG. 5, which leads to disengagement of the shifting mechanism such that repeated release of the actuating lever 8 allows the refill 4 together with its writing tip 3 and the shifting mechanism 5 to move back, under the restoring action of the spring 7, into the rest position illustrated in FIGS. 1 and 4.

It is evident from FIGS. 1 to 6 that, in the described embodiment, the push button 6 has a taper comprising or forming the oblique face 9 on its side facing the actuating lever 8. The surface comes increasingly closer or converges in the direction of a central axis 11 of the writing implement 1 and moves the shifting mechanism 5 away from the writing tip 3. This conical or tapered shape of the oblique face 9 of the push button 6 is clearly shown in FIGS. 5 and 6, where the oblique face 9, is not covered by the actuating lever 8.

A recess 12, which has a negative oblique face 10, is formed at the end of the actuating lever 8 facing the push button 6. In the rest position as shown in FIGS. 1 and 4, the recess 12 engages around and over and receives the oblique face 9 or the conical taper of the push button 6, thereby defining a mutual rest and starting position for the push button 6 and the actuating lever 8.

The recess 12 is symmetrical about the central axis of the actuating lever 8. With the oblique areas of its oblique face 10 arranged on opposite sides of the central axis, the recess 12 engages the taper of the oblique face 9 at the end of the push button 6 in the rest position in a planar or fitted and symmetrical manner, as best shown in FIG. 4. This makes it possible for the actuating lever 8 to be pivoted in the opposite direction, compared to what is shown in FIG. 5, to achieve the same effect and the same axial displacement of the push button 6. The user can thus pivot the actuating lever 8 in opposite directions and in either case achieve the desired axial displacement of the refill 4 with its writing tip 3.

An all round pivoting of the actuating lever 8, i.e. actuation on all possible sides or directions with respect to the shaft 2, can be achieved if the oblique face 9 is the surface of a frustum, as is the case in the described embodiment. Other possible shapes include a pyramid, cone, and part of a sphere. The recess 12 of the actuating lever 8 is also frusto-conical, whereby (horizontal) cross-sections through the taper of the push button 6 and the recess 12 of the actuating lever 8 are circular.

To this end, the actuating lever 8 has a matching negative contour and is mounted so as to be pivotable on all sides in a manner to be described below, in order not to prescribe a specific pivoting direction of the actuating lever 8 for the user, but to allow him to pivot the actuating lever 8 in any direction and yet able to displace the refill 4 accordingly each time.

The contact region at the end of the actuating lever 8 facing and acting upon the push button 6 and its oblique face 9, i.e. the recess 12 in the embodiment, is arranged on a generally spherical thickened or enlarged portion 13 of the actuating lever 8, which has a considerably larger radial dimension than the actuating lever 8 itself. An annular undercut 14 is formed within the end region of the shaft 2, which is part spherical and engages around and supports the spherical portion 13 of the actuating lever 8 for pivotal movement, and also bounds the pivoting path of the actuating lever 8, as can be visualised in FIGS. 4 to 6.

The diameter at the narrowest part of the undercut 14 is thus smaller than the largest diameter of the spherical portion 13, thereby avoiding the spherical portion 13 from falling out of the end region of the shaft 2. The tapering shaft 2, which comprises or forms the undercut 14, itself forms a pivot for the spherical portion 13 and co-operates with the latter to allow pivoting of the actuating lever 8.

The thickened spherical portion 13 of the actuating lever 8 may be movable or displaceable from the undercut 14, downwards in the axial direction of the shaft 2 towards the writing tip 3. In this case, as can be understood from FIG. 6, the actuating lever 8 could be displaced axially downwards to reach the push button 6. This means that in the position as shown in FIG. 4, the actuating lever 8 could also be pressed down in a simple manner to move the push button 6 into the position as shown in FIG. 5. Likewise, the push button 6 can be moved from the position of FIG. 6 back into the position of FIG. 5 by pressing the actuating lever 8 down completely to release the shifting mechanism 5, whereupon the restoring spring 7 can displace the refill 4 and the shifting mechanism 5 back into the rest position of FIG. 4. In this way, the user is given a further possibility of actuation, i.e. he can pivot the actuating lever 8 in any desired direction or, alternatively or simultaneously, press it down in order to operate the shifting mechanism 5.

Although it is possible for the thickened spherical portion 13 to be supported from both above and below, so as to prevent any axial movement or actuation of the lever 8, this would represent an increased manufacturing outlay.

Figure 7:
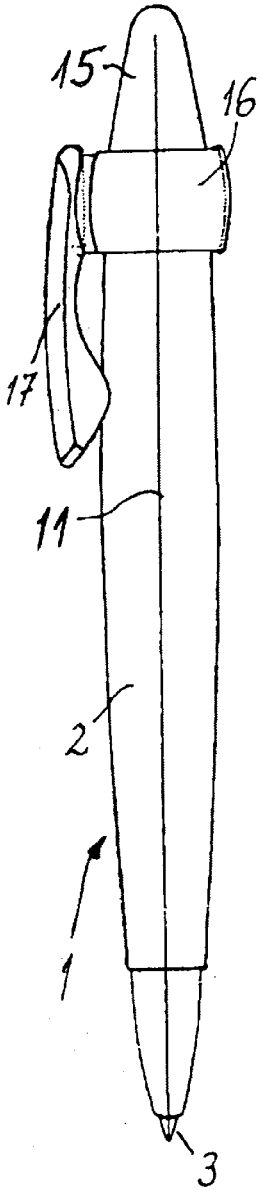
FIG. 7 is an external side view of the writing implement, with the writing tip displaced into the writing position and including a covering cap (not shown previously) for the actuating lever.

FIGS. 1 and 7 show that the actuating lever 8 projecting from the upper end of the shaft 2 can be enclosed for protection by a cover 15 of resilient, in particular rubber-resilient, material, so that it can be bent laterally as well as deformed axially. The resilient cover 15 surrounds a free end 8*a* of the actuating lever 8 and touches it at least when it is actuated, so that by virtue of its resilience the cover 15 can act at the same time as a restoring element for automatically centering the pivotable actuating lever 8. If the actuating lever 8 is pivoted into the position of FIG. 2 or 5, the cover 15 (not illustrated in these figures for the sake of clarity) is in fact resiliently deformed accordingly, so that when the actuating lever 8 or the cover 15 surrounding it is released, the cover 15 returns to its normal straight position by virtue of its resilience, thereby bringing the actuating lever 8 back to the corresponding upright position. The actuating lever 8 thus regains its initial upright position of FIG. 3 or 6 or, with a reverse movement, that of FIG. 1 or 4. In addition, the cover 15 prevents the actuating lever 8 from removal from the shaft 2.

The resilient cover 15 is shaped like an elongate cap, having its edge clamped between the shaft 2 and a retaining ring 16 for a clip 17 of the writing implement 1. As best shown in FIGS. 4 to 6, an annular groove 19 is formed below an annular undercut 18 in the retaining ring 16, in which the edge of the covering cap 15 is clamped in position for use. More specifically, the cap edge is clamped onto the end of the shaft 2 by pressing or, as shown, screwing the retaining ring 16 axially thereon. Screwing thread 20 between the shaft 2 and the retaining ring 16 can be seen in FIGS. 4 to 6. The retaining ring 16 has two functions, which are carrying the clip 17 and securing the resilient cover 15 in a manner such that the cover 15 can be released or dismantled and replaced.

The operation of the actuating lever 8 and the transmission of its pivoting movement to the axially displaceable push button 6 are facilitated by reason of the push button 6 having an enlarged mushroom head to provide an extended said oblique face 9 thereon facing the actuating lever 8. For this purpose, the shaft 2 has an enlarged diameter for receiving this mushroom head and the correspondingly enlarged spherical portion 13 of the lever 8, which also provides a suitable abutment or shoulder for locating the retaining ring 16.

The writing implement 1 has the refill 4 displaceable axially by means of the shifting mechanism 5, and the shifting mechanism 5 is associated with the push button 6 for the axial displacement against the action of the restoring spring 7 that moves the refill 4 back into the rest position when the push button 6 is actuated again. The actuating lever 8 projects beyond the upper end of the shaft 2 and is mounted for pivotal movement about it. Such movement is convertible into axial movement of the push button 6 by way of the oblique face 9 on the side thereof opposite the shifting mechanism 5, with the push button 6 being protected within the shaft 2. Such a construction simplifies and facilitates actuation of the pressing or shifting mechanism 5 through pivoting movement, as well as depression, of the actuating lever 8, whilst the push button 6 is fully protected in the interior of the shaft 2.

The invention has been given by way of example only, and various modifications of and/or alterations to the described embodiment may be made by persons skilled in the art without departing from the scope of the invention as specified in the appended claims.

What is claimed is:

1. A writing implement comprising:

a shaft;

a refill having a writing tip and displaceable co-axially in the shaft;

a resilient restoring member acting between the shaft and the refill;

a shifting mechanism and a push member associated with the shifting mechanism, the shifting mechanism being actuable by the push member for displacing the refill and the writing tip into a writing position against action of the restoring member and which, upon repeated actuation, is displaced and returned to a rest position, the push member co-operating with and moving the shifting mechanism and the refill axially in the shaft and refill;

an actuating lever projecting from the shaft, remote from the writing tip, and pivoting with respect to the shaft, the actuating lever acting upon a side of the push member remote from the shifting mechanism, and converting the pivoting of the actuating lever into axial movement of the push member; and a resiliently deformable cover enclosing the actuating lever projecting from the shaft.

2. The writing implement according to claim 1, including at least one oblique face for contact of the actuating lever and the push member, on at least one of the actuating lever and the push member, converting the pivoting of the actuating lever into the axial movement of the push member.

3. The writing implement according to claim 2, wherein the at least one oblique face has, at least in part, one of a substantially planar, convex, and concave surface.

4. The writing implement according to claim 2, wherein one of the oblique faces is provided on each of the actuating lever and the push member, mutually touching and slidable relative to each other, during the pivoting of the actuating lever.

5. The writing implement according to claim 1, wherein the push member has, on a side facing the actuating lever, an oblique face that becomes smaller with distance from the writing tip along a central axis of the writing implement, and a recess, engaging the oblique face of the push member in the rest position, located at an end of the actuating lever adjacent the push member.

6. The writing implement according to claim 5, wherein the recess is substantially symmetrical about a central axis of the actuating lever, and the oblique face engages mutually opposite sides of the push member in the rest position.

7. The writing implement according to claim 5, wherein the oblique face has a shape of one of a pyramid, a cone, a frustum, and part of a sphere, and the recess has a contour complementing the oblique face, such that the actuating lever is operable in more than one direction.

8. The writing implement according to claim 1, wherein the actuating lever includes a substantially spherical enlarged portion acting upon the push member, and the shaft includes an undercut engaging the spherical portion and supporting the actuating lever for the pivoting.

9. The writing implement according to claim 8, wherein the spherical portion of the actuating lever is movable in an axial direction of the shaft with respect to the undercut.

10. The writing implement according to claim 1, including a resiliently deformable cover enclosing the actuating lever projecting from an end of the shaft.

11. The writing implement according to claim 1, wherein the cover surrounds a free end of the actuating lever in the rest position and automatically centers the pivotable actuating lever.

12. The writing implement according to 1, including a retaining ring and a clip of the writing implement wherein the cover has an edge clamped between the shaft and the retaining ring.

13. The writing implement according to claim 1, wherein the push member has a substantially mushroom-shaped head with an oblique face.

* * * * *